United States Patent [19]

Mrenna et al.

[11] Patent Number: 4,719,438

[45] Date of Patent: Jan. 12, 1988

[54] CIRCUIT BREAKER WITH FAST TRIP UNIT

[75] Inventors: Stephen A. Mrenna, Brighton Township, Beaver County; Kurt A. Grunert, Beaver; Jonathan Weiss, Pittsburgh; Vijay K. Garg, Murrysville, all of Pa.

[73] Assignee: Westinghouse Electric Corp., Pittsburgh, Pa.

[21] Appl. No.: 913,877

[22] Filed: Sep. 30, 1986

[51] Int. Cl.[4] ..... H01H 75/10; H01H 77/04; H01H 81/00; H01H 83/00

[52] U.S. Cl. ..... 335/38; 335/42; 335/236; 335/162

[58] Field of Search ..... 335/37, 38, 40, 41, 335/42, 174, 162, 176, 236, 237, 163, 45

[56] References Cited

U.S. PATENT DOCUMENTS 3,162,739 6/1962 Klein et al. ..... 335/38

3,777,293 12/1973 Tuzuki ..... 335/237

FOREIGN PATENT DOCUMENTS 1072669 1/1953 France ..... 335/236

2006743 4/1969 France .

*Primary Examiner*—E. A. Goldberg

*Assistant Examiner*—Lincoln Donovan

*Attorney, Agent, or Firm*—L. P. Johns

[57] ABSTRACT

A circuit breaker structure having a faster trip unit characterized by a circuit breaker operator and a trip unit comprising a coil, a core, and an armature, a flux concentrating plate spaced from and on the side of the armature opposite the core and for concentrating the magnetic field between the core and the armature, and a hold-back bracket having extending from and retaining the armature in a spaced position from the core so as to cause the magnetic field lines to flow through the bracket and the armature.

10 Claims, 14 Drawing Figures

FIG.3
PRIOR ART
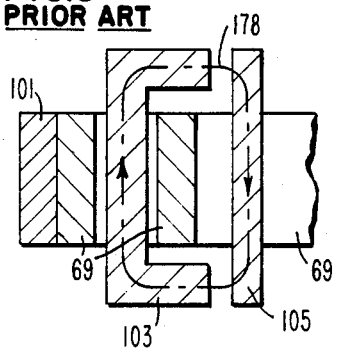
FIG.4
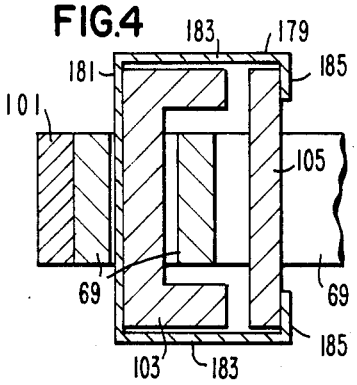
FIG.5
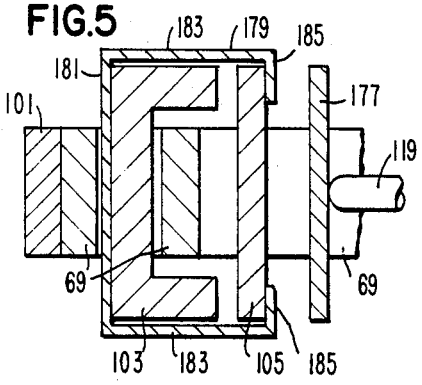
FIG.6
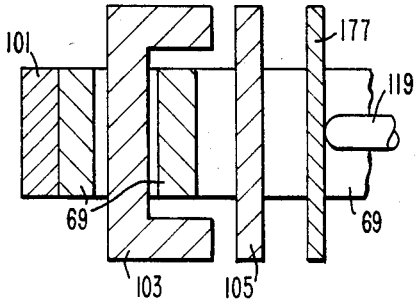
FIG.7
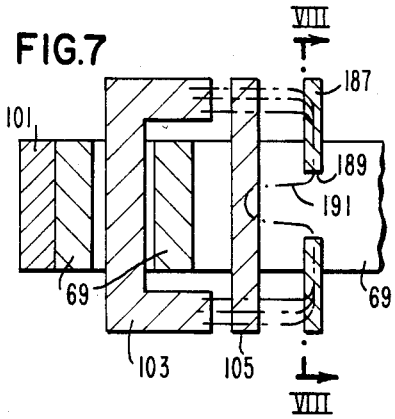
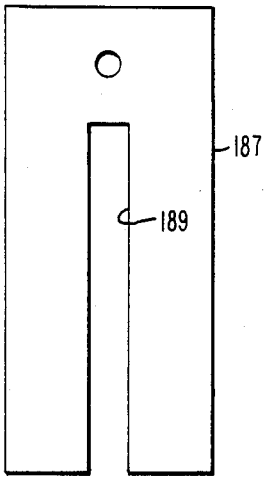
FIG.8
9438

FIG.9
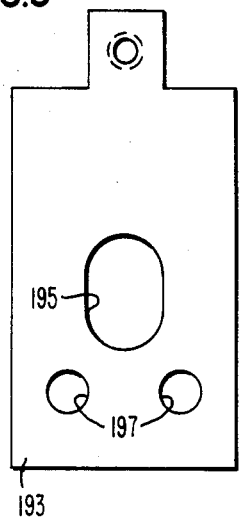
FIG.10
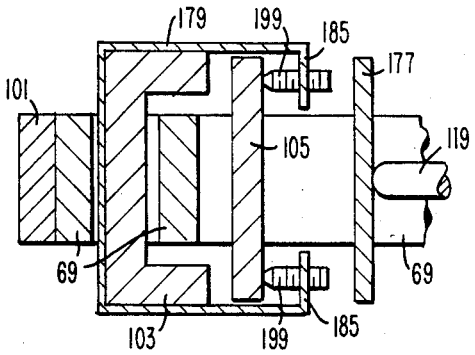
FIG.14
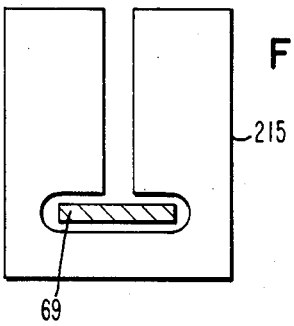
FIG.11
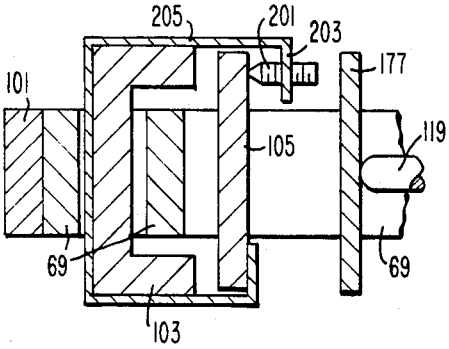
FIG.12
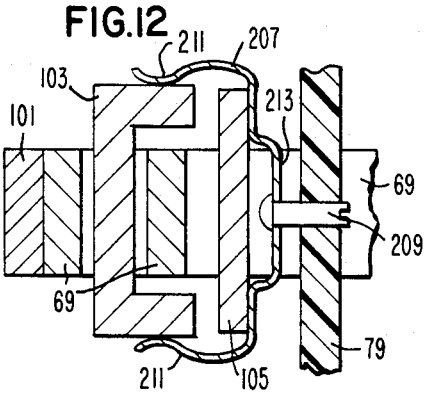
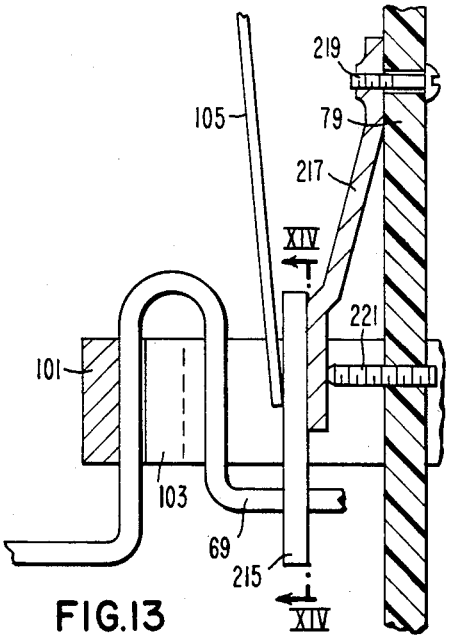
FIG.13

CIRCUIT BREAKER WITH FAST TRIP UNIT

CROSS REFERENCE TO RELATED APPLICATION

This application is related to copending application Ser. No. 858,137, filed Apr. 30, 1986, entitled "Circuit Breaker With Adjustable Magnetic Trip Unit"; of which the inventors are S. A. Mrenna and M. Whipple, assigned to the assignee of this application.

BACKGROUND OF THE INVENTION

1. Field of the Invention

This invention relates to a circuit breaker having a faster acting trip unit and, more particularly, it pertains to a magnetic trip unit in which magnetic flux lines are concentrated between a core and armature.

2. Description of the Prior Art

The circuit-interrupting art is everchanging and compact circuit breakers have evolved that comprise overcurrent protective devices, or trip units, that function in response to such abnormal currents as overcurrents, ground fault currents, and short circuits that occur in an electrical distribution system. Such trip units are disclosed in U. S. Pat. Nos. 3,530,414; 3,797,007; 3,808,847; 3,815,064; 3,950,716; 3,950,717; 4,074,218; and 4,313,098. Although these circuit breakers have a greater range for adjusting for specific trip currents between maximum and minimum air gaps between the magnet and the armature of the trip units, there is a need for a device that provides for faster tripping action at a predetermined overcurrent condition. This is especially true for fast acting current limiting circuit breakers.

SUMMARY OF THE INVENTION

In accordance with this invention, it has been found that a circuit breaker structure having a faster trip action is comprised of a circuit breaker mechanism having separable contacts and having a releasable member movable to an unlatched position from a latched position to effect opening of the contacts; a latch lever movable between latched and unlatched positions of the releasable member and being biased in the latched position; a trip bar movable to unlatch the latch lever and being biased in the latched position; a trip unit comprising a stationary magnetic structure for each conductor of the distribution system and including a coil and first core assembly and an armature; lever means associated with each stationary magnetic structure for moving the trip bar to the unlatched position; the lever means comprising the armature and movable toward the core in response to abnormal currents in at least one of the conductors; a flux concentrating plate spaced from and on the side of the armature opposite the core and for concentrating a magnetic field in an ambient space between the core and the armature; and the flux concentrating plate including calibration means for moving the plate to and from the armature so as to adjust the magnetic field density, or magnetic force.

The invention also includes the foregoing structure in which a hold-back bracket is mounted on the core and comprises a pair of inturned flanges spaced from the core, the aperture being disposed between the core and the flanges so as to increase the magnetic flux density between the core and the armature, the core, such as a core having a U-shaped configuration having spaced first U-legs, and an armature responsive to a predetermined overcurrent condition, and in which a hold-back bracket extending along the core and beyond the armature, so as to cause magnetic field lines to flow through the flanges.

The advantage of the circuit breaker of this invention is that it provides an improved trip unit that decreases the unlatching time on a short circuit.

BRIEF DESCRIPTION OF THE DRAWINGS

FIG. 3 is a horizontal sectional view through the assembly of the conductor core and armature of a prior art unit;

FIG. 4 is a horizontal sectional view through the core, coil, armature, and hold back bracket;

FIG. 5 is a view similar to that of FIG. 4 with a flux concentrating plate added in accordance with this invention;

FIG. 6 is a horizontal sectional view through the core, coil, armature, and flux concentrating plate with the hold-back bracket omitted;

FIG. 7 is a figure similar to that of FIG. 6 of another embodiment of the invention;

FIG. 8 is a vertical sectional view taken on the line VIII—VIII of FIG. 7;

FIG. 9 is an elevational view of another embodiment of the flux concentrating plate;

FIGS. 10, 11, and 12 are horizontal sectional views of other embodiments of the invention;

FIG. 13 is an elevational view of an assembly of a core, coil, armature, and a second core-coil assembly; and FIG. 14 is a vertical sectional view taken on the line XIV—XIV of FIG. 13.

DESCRIPTION OF THE PREFERRED EMBODIMENTS

The circuit breaker mechanism of this invention is of the type that is generally described in above-mentioned copending application Ser. No. 858,137, filed Apr. 30, 1986 and is incorporated by reference herein.

Figure 1:
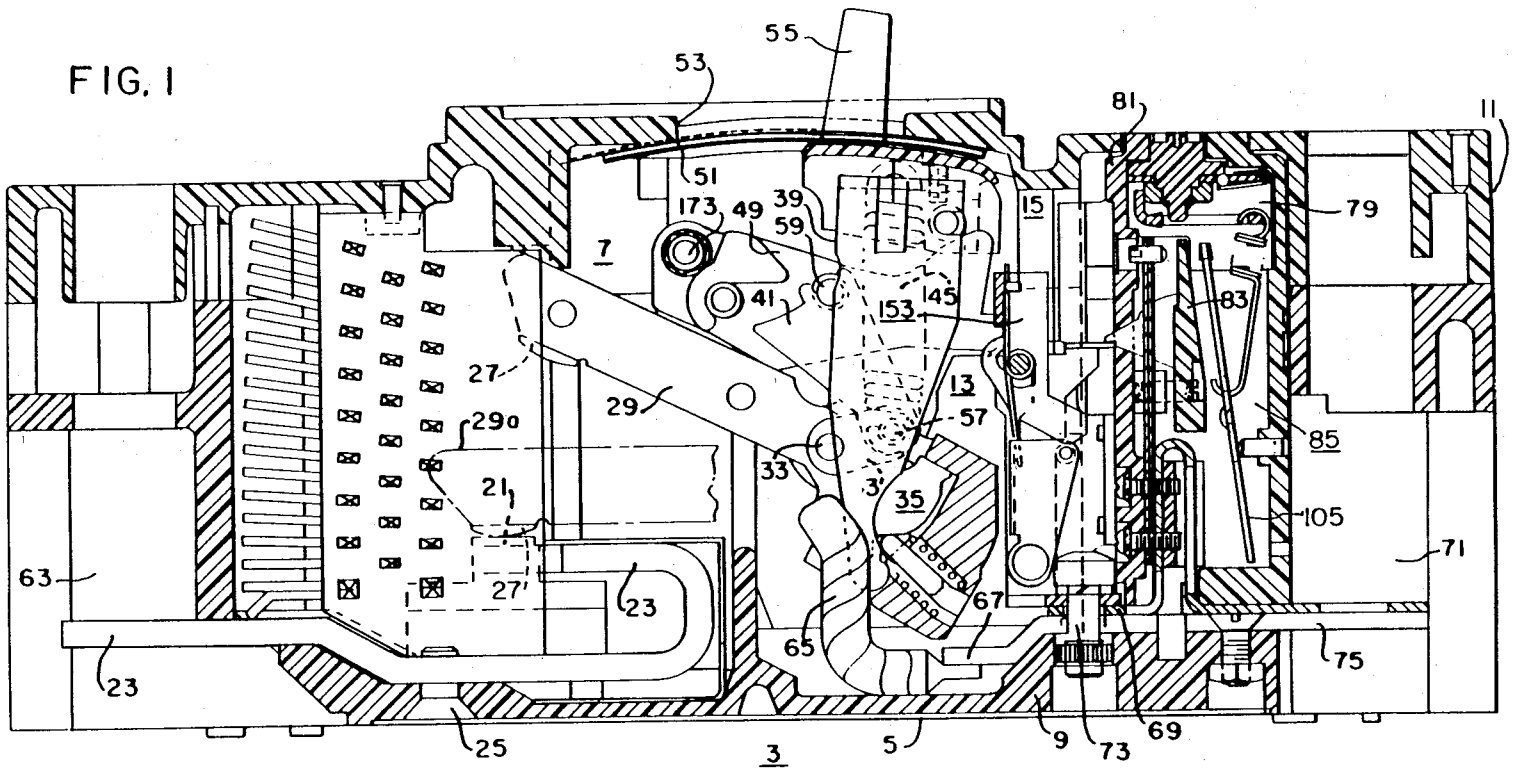
FIG. 1 is a vertical sectional view of a multi-pole circuit breaker.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a pivot pin 33. The arm 29 for all three of the pole units is supported at one end thereof a rigidly connected on a common insulating tie bar 35 by which the arms of all three pole units move in unison. Each of the contact arms 29 is biased about the associated pivot pin 33.

The operating mechanism 13 actuates the switch arms 29 between open and closed positions. The mechanism comprises a pivoted formed operating lever 39, a toggle comprising two toggle links 41 and 43, overcenter spring 45 and a pivoted releasable cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by the pin 33.

The overcenter spring 45 is connected under tension between the knee pivot pin 57 and the outer end of the operating lever 39. The circuit breaker is manually operated to the open position by movement of the handle portion 55 is a clockwise direction, which movement actuates the overcenter spring 45 to collapse the toggle links 41 and 43 to the "off" position (FIG. 1), and opening movement of the contact arm 29 for all of the pole units in a manner well known in the art.

The circuit breaker is manually closed by counterclockwise movement of the handle portion 55 from the "off" position to the "on" position, which movement causes the spring 45 to move overcenter and straighten the toggle links 41, 43, thereby moving the contact arm 29 for all of the pole units to the closed position as shown in broken line position 29*a*.

The trip device 15 serves to effect automatic release of the releasable cradle or arm 49 and opening of the breaker contacts for all of the pole units, in response to predetermined overload conditions in the circuit breaker through any or all pole units of the circuit breaker, in a manner described hereinbelow.

The circuit through each pole unit extends from a left-hand terminal 63 through the conductor 23, the contacts 21, 27, the contact arm 29, a flexible conductor 65, a conductor 67, a trip conductor 69, and to a right-hand terminal 71. Bolt 73 secures one end of the trip conductor 69 to the conductor 67 and the other end of the trip conductor 69 is disposed between a backup plate 75 and the terminal 71.

Figure 2:
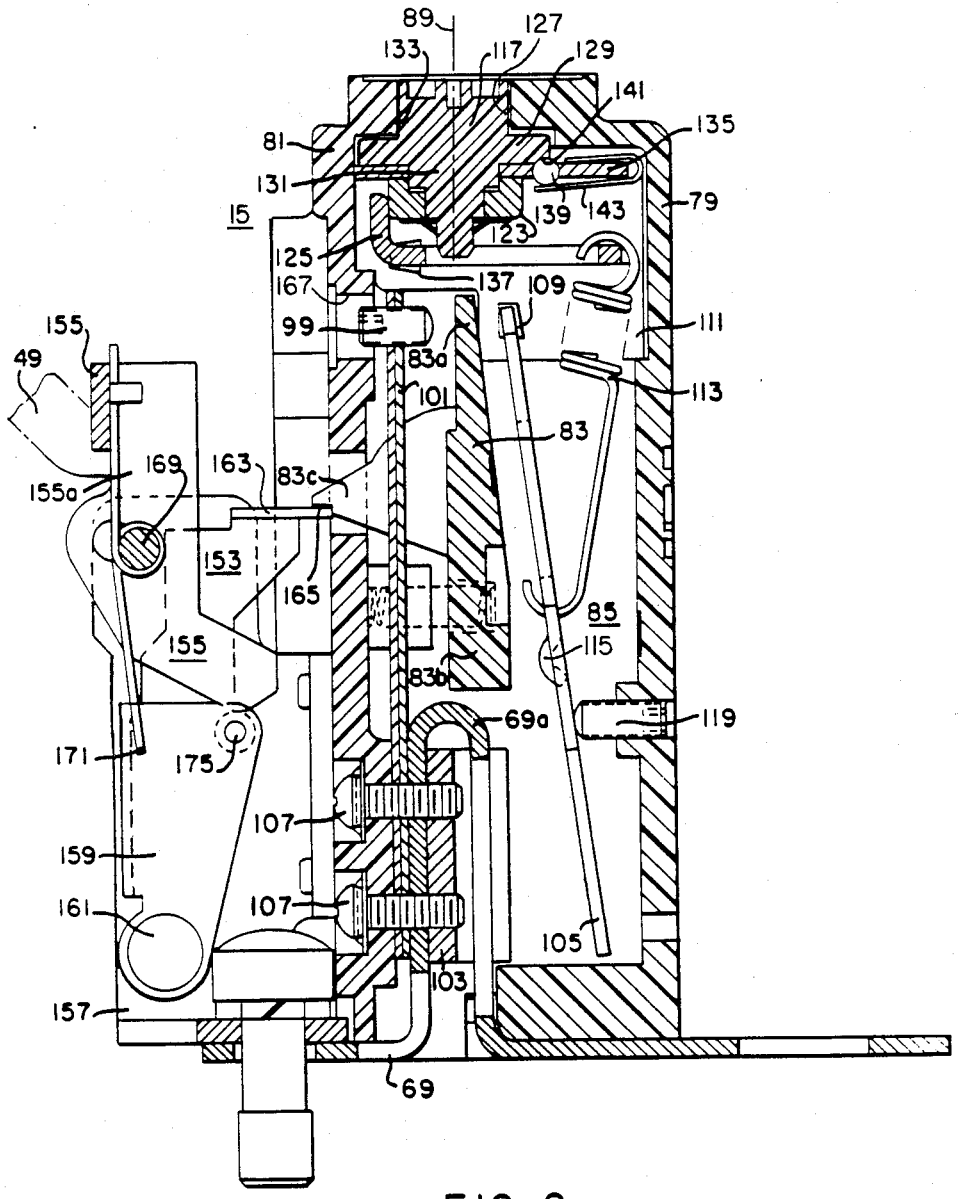
FIG. 2 is an enlarged vertical sectional view of a part of FIG. 1.

As shown in FIG. 2, the latch and trip device 15 comprises a molded insulating housing base 81 and a molded insulating housing cover 79 secured to the base to enclose a molded insulating trip bar 83 that is common to all three of the pole units. The base 81 (FIG. 2) includes a pair of similar spaced partitions of which one partition 85 is shown which are vertically disposed and integral with the base for separating the interior of the housing into three compartments, each compartment containing one of the three poles. In a similar manner, the cover 79 is provided with partitions corresponding to said spaced partitions and having mating surfaces therewith in a manner similar to the mating surfaces of the peripheral surfaces of the base 81 and cover 79 as indicated by as parting line 89.

The spaced partitions serve as journals for the trip bar 83. Accordingly, when the housing base 81 and cover 79 are assembled, the trip bar 83 is retained in place and is free to rotate. Each section of the trip bar 83 located within the space compartments of the housing comprises upper and lower portions 83*a* and 83*b*, which are above and below the axis of rotation of the trip bar. Each upper portion 83*a* cooperates with a screw 99 on a bimetal member 101 for adjusting the spacing between the upper ends of the bimetal member and the trip bar portion 83*a* in response to the degree of deflection of the upper end of the member 101 toward the member 83*a*, whereby the trip bar 83 is rotated clockwise by the bimetal member and thereby trips the circuit breaker to the open position. The lower end portion 83*b* of the trip bar 83 is rotated by an armature 105 in the manner to be described hereinbelow.

The trip conductor 69 (FIG. 2) includes an inverted U-shaped intermediate portion 69*a* which constitutes a single looped coil of a stationary magnet, which also comprises a magnetic core 103 and an armature 105. The assembly of the intermediate U-shaped portion 69*a*, the core 103, and the lower portion of the bimetal member 101 are secured in place by suitable means such as screws 107 on the housing base 81. The lower end portion of the bimetal member 101 is in surface-to-surface contact with the conductor 69, whereby upon the occurence of a low persistent overload current below a predetermined value of, for example, five times normal rated current, the bimetal member 101 is heated and deflects to the right through an air gap dependent upon the setting of the adjustment screw 99. Thus, the trip bar 83 is actuated to trip the circuit breaker.

The armature 105 is pivotally mounted in an opening 109 on a holding bracket 111 and is biased in the counterclockwise direction by coil springs 113 (FIG. 2). The armature has a projection 115 and is movable clockwise against the spring to rotate the trip bar 83 clockwise. When an overload current above a value such, for example, as five times normal rated current or a short circuit current occurs, the stationary magnetic structure is energized and the armature 105 is attracted toward the core 103, causing release of the arm 49 and opening of the contacts 21 and 27.

A calibration screw 119 is provided in the housing cover 79 for adjusting the spacing between a flux concentrating plate 177 (FIG. 5) and the core 103, whereby upon maximum spacing of the plate 177 from the core, the flux density is reduced and a greater current is required to attract the armature toward the core. Conversely, when the spacing is reduced, the flux density is increased and a smaller overload current is required to actuate the trip bar 83. However, inasmuch as the trip unit 15 comprises an adjusting knob 117, the calibration screw 119 is preset to a prescribed flux density after final assembly.

The adjusting knob 117 is provided for changing the rating of the circuit breaker 15 by varying the force on the spring 113. The adjusting knob 117 is part of a spring tensioning assembly which also includes a cam 123, and a cam follower 125. The adjusting knob 117 includes a circular surface 127, a radial flange 129, and a shaft 131 on which the cam 123 is mounted. The adjusting knob 117 is mounted within a circular opening 133 of the housing. The adjusting knob 117 is retained in place by a retainer 135 which is part of the holding bracket 111.

The cam follower 125 is a lever, such as a bell crank, having one end portion contacting the surface of the cam 123 and the other end portion connected to the upper end of the coil spring 113. The lower end of the spring is connected to the armature 105. The cam follower is pivotally mounted in an opening 137 of the holding bracket 111. In this manner the tension of the spring 112 holds the cam follower 125 against the cam surface 123.

Associated with the adjusting knob 117 is an index means including a ball bearing 139, and spaced indentations 141 around the lower surface of the radial flange 129 for receiving the ball bearing at prescribed positions of rotation of the index knob 117. A leaf spring 143 retains the ball bearing in place within an aperture of the retainer 135. The ball bearing 139 provides positive indexing or indication of the position of the knob as established by the spaced positions of the indentations 141 around the flange 129. An advantage of the ball bearing 139 is that it reduces rotational friction by rolling on the surface of the flange 129, thereby facilitating rotation of the knob. When the ball bearing 139 is seated within an indentation 141, any vibrations occurring within the circuit breaker are less likely to change the setting of the knob and thereby alter the rating established thereby.

The mechanism by which the releasable arm 49 is released is shown in FIGS. 1, 2. The mechanism includes the trip bar 83, a trip lever 153, and a latch lever 155. A U-shaped mounting frame 157 is mounted on the base 81 with similar spaced upright sides 157 (one shown) providing mounting support for the levers. The trip lever 153 includes a U-shaped lever 159, the lower end of which is mounted on a pivot pin 161 which extends from the sides 157 of the frame. The U-shaped lower portion of the lever 159 maintains the lever upright adjacent the frame side 157. The upper end of the trip lever 153 includes a flange 163 which engages a notch 165 on the trip bar 83. As shown in FIG. 2 a portion of the trip bar extends through an opening 167 in the insulating base 81.

The latch lever 155 is mounted on a pivot pin 169 the similar opposite sides 157 of the frame 157. A spring 171 is mounted on the pin 169 and has end portions engaging the levers 153 and 159 for biasing the levers in the latched positions. When the releasable arm 49 is in the latched position (FIG. 1), the arm, which is pivoted on a pivot pin 173, is secured in the latched position below the lever 155 and applies a rotatable force thereon. The latch lever 155 is prevented from turning due to engagement of the lower end of the lever on a pin 175 which is mounted in the U-shaped portion 159 on the trip lever 153. As a result of the rotating force on the latch lever 155, the trip lever 153 is biased clockwise and is prevented from movement by engagement of the flange 163 in the notch 165 of the trip bar 83. When the trip bar is rotated clockwise, the flange 163 is dislodged from the latched position within the notch 165 and the trip lever 153 rotates clockwise to move the pin 175 from engagement with the lower end of the latched lever 155. As a result the latch lever 155 is free to rotate about the pin 169 and thereby unlatch the releasable arm 49 from the latched position.

In the prior art unit (FIG. 3), when a predetermined overcurrent condition occurred through the conductor 69, a magnetic flux 178 circulating in the core 102 and the armature 105 became sufficiently strong to attract and move the armature to the end faces of the core, thereby tripping the trip bar 83. However, it was found that there was not enough magnetic force to hold the armature all the way open or closed. At normal currents, the armature should be completely open. But if the spring 113 is adjusted sufficiently to hold the armature completely open, a response to lower fault current ratings is lost. This occurs particularly in the case of a current pulse that is above the threshold to cause a trip cycle, but of a short time duration (2 to 3 milliseconds). Here there will be an initial pull of attraction for the armature, 105, but not long enough to permit it to actuate the trip bar.

Between some current values, under short pulse condition found in fast acting current limiting circuit breakers, such as 12Kamp–18Kamp, there is sufficient current pulse to cause the arms 29 to open and stay open (due to this desirable blow open action to cause current limiting), but not enough energy in the pulse to cause the trip bar to be operated. Thus, the breaker may have one arm 29 open. The trip indication via the handle 55 still indicates a breaker in the "on" mode; all due to the fact that the trip unit did not function.

To correct this problem, it was necessary to create a magnetic force on the armature so that it is in a fully retracted position from the core under normal operating conditions. As shown in FIG. 4, a hold-back bracket 179 is provided to generate a greater magnetic hold-back force between the core 103 and the armature 105. The hold-back bracket 179 is a generally U-shaped member having an intermediate portion 181, leg portions 183, and inturned flange portions 185. The bracket 179 contributes to a magnetic field density or holding force between the flanges 185 and the armature 105, thereby retaining the armature in a fully retracted position from the core 103 due to the concentration of magnetic flux lines in response to the presence of the bracket 179.

The provision of the bracket 179 to the current art structure (FIG. 4) solves the problem of "hang-up" of the armature. However, it does not easily permit exact calibration of the assembly. Calibration is necessary to control the trip at certain values of current by controlling the air gap between the armature and the core. In the prior art unit, calibration was difficult, because the control of the magnetic flux between the armature and the core was difficult and impractical to maintain; there was no room to really adjust the gap.

In accordance with this invention (FIG. 5) a flux calibrating plate 177 is provided to enable calibration. In the preferred embodiment of FIG. 5, the combination of the plate 177 and the hold-back bracket 179 provides a solution to the problem of armature "hang-up" that existed with the prior art structure (FIG. 3). The plate 177 in combination with the bracket 179 enables more complete collection and concentration of magnetic flux lines between the core and the armature. The plate 177 increases the total magnetic filed within the volume of the core and armature. Calibration is achieved by adjusting the spacing between the plate and core, thus shaping the magnetic field for calibration.

It is pointed out, however, that a workable embodiment (FIG. 6) is operable without the bracket 179. In this embodiment, though a fraction of the flux leaks from the core 103 to the plate 177, the plate confines the magnetic field to a smaller volume or ambient space, thus increasing the maximum magnetic field density in the area of the core and the armature. This is true even though the magnetic field density generated by the hold-back bracket 179 provides a more satisfactory force between the armature 105 and the bracket.

In another embodiment (FIGS. 7 and 8) a flux concentrating plate 187 having a longitudinal slot 189 is provided to enable leakage of flux 191 between the plate portions and armature 105. A hold-back force is generated between the plate 187 and the armature 105 which can be controlled by the width of the slot. More particularly, the magnetic flux from the core may leak to the slotted plate 187, return through the armature 105, then again to the plate, then back to the core. Thus, the flux from the plate to the armature generates a holding force on the armature which under some circumstances may negate the need for the hold-back bracket 179.

In FIG. 9, another embodiment of the plate 193 is shown provided with a plurality of apertures 195, 197. The apertures weaken or reduce the magnitude flux from the maximum effect without the holes. The holes control the holding force on the armature 105 such that the more or larger the holes, the smaller the magnetic force.

Although the bracket 179 generates the hold-back force due to the main flux between the armature 105 and the bracket, the force opposes the attractive or pulling force between the core 103 and the armature. The net force on the armature is reduced as compared to the prior art embodiment (FIG. 3), and therfore there is a problem of calibration. The plate 177 confines the flux to the smaller volume between the bracket base surface and the plate, thus increasing the magnitude of the flux density between the core and the armature.

In the embodiment of FIG. 10, means to control the hold-back force are provided, such as set screws 199, whereby the spacing or air gap between the armature and the flanges 185 may be varied.

A variation of the structure of FIG. 10 is shown in FIG. 11 in which a set screw 201 is mounted in a flange 203 of a bracket 205 for varying this spacing or air gap between the armature and the bracket legs. In the embodiment of FIG. 11, calibration is more complex than that shown in FIG. 10.

Another embodiment of the invention is shown in FIG. 12 in which a C-shaped bracket or hat 207 is provided to leak flux from the core 103 to generate a hold-back force on the armature 105. This embodiment replaces both the plate-177 and the bracket 179 of the embodiment of FIG. 5. A set screw 209 extends between the housing cover 79 and the bracket 207 for calibrating the air gap between the armature 105 and the core 103. The bracket 207 includes in-turned legs 211 for slideable contact with the legs of the core 103 in conjunction with rotation of the set screw 209. In operation, the flux lines go mainly to the armature 105 and very little of the lines traverse the intermediate portion 213 of the bracket 207. Thus, the bracket satisfies the requirement for the hold-back force and calibration between the core 103 and the armature 105.

The embodiment of the invention shown in FIG. 13 replaces the bracket 179 (FIG. 5) with a second core 215, as shown more particularly in FIG. 14. The second core 215 surrounds the conductor 69 and extends upwardly between the armature 105 and a back-up plate 217 which is composed of a non-magnetic material such as brass. The upper end of the back-up plate 217 is secured to the housing cover 79 by suitable means such as a screw 219. A set screw 221 in the housing cover 79 is provided to calibrate the assembly of the core 215 and the armature 105. The magnitude of the force between the core 103 and the armature 105 is controlled by the set screw 221 to change the spacing for air gap between the armature 105 and the core 103.

In summary, the magnetic force is proportional to the magnetic field density squared ($B^2$). By adding the flux concentrating plate, the volume or ambient space surrounding the core and the armature is reduced and the magnetic field density is increased so that there is a larger magnetic force pulling the armature toward the core for the same current rating.

The hold-back bracket sustains a weak magnetic field that holds the armature fully retracted from the core. The legs of the bracket hold the armature at the proper air spacing for achieving the magnetic trip and avoid nuisance tripping. It is desirable that the armature be set at the optimum air gap from the core, i.e., 0.1 inch, for a proper calibration of 4,000 amperes.

The flux concentrating plate is bent toward the pole face by a calibration screw to increase the flux density between the armature and the magnet. That is, there are more flux lines to increase the force between the armature and the core. There is no physical contact between the plate and the armature, only air, in this embodiment. Surface contact, could under conditions of space limitation, permit similar hold back adjustment but requiring a different area or magnetic field density.

In conclusion, in combination of the hold-back bracket and the flux concentrating plate, enable calibration and a fast trip action.

We claim:

1. A circuit breaker structure having a faster trip action, comprising:

a circuit breaker mechanism having separable contacts and having a releasable member movable to an unlatched position from a latched position to effect opening of the contacts;

a latch lever movable between latched and unlatched positions of the releasable member and being biased in the latched position;

a trip bar movable to unlatch the latch lever and being biased in the latched position;

a trip unit comprising a stationary magnetic structure for each conductor of the distribution system and including a coil and first magnetic core assembly and an armature;

lever means associated with each stationary magnetic structure for moving the trip bar to the unlatched position;

the lever means comprising the armature and movable toward the core in response to abnormal currents in at least one of the conductors; and a flux concentrating magnetic plate separated from the magnetic core assembly and spaced from and on the side of the armature opposite the core and for concentrating a magnetic field in an ambient space between the core and the armature.

2. The circuit breaker of claim 1 in which the flux concentrating plate includes calibration means for moving the plate to and from the armature so as to adjust the magnetic field density.

3. The circuit breaker of claim 2 in which a hold-back bracket is mounted on the core and comprises a pair of inturned flanges spaced from the core and the armature being disposed between the core and the flanges so as to increase the magnetic flux density between the core and the armature.

4. The circuit breaker of claim 1 in which the core is a U-shaped member having spaced first U-legs with the armature spanning and being movable toward the U-legs in response to a predetermined overcurrent condition, and in which a hold-back bracket is mounted on the core with second U-legs extending along and beyond the ends of the first U-legs and beyond the armature, each second U-leg having an inturned flange adjacent to the armature so as to cause magnetic field lines to flow through the flanges and the armature.

5. The circuit breaker of claim 2 in which a second core is around the conductor, and extending between the armature and the flux concentrating plate which plate is non-magnetic material so as to create a hold-back force on the armature.

6. The circuit breaker of claim 5 in which a set screw is associated with the plate to establish the spacing between the armature and the first core.

7. The circuit breaker of claim 3 in which the armature is disposed between the flanges and the first U-legs.

8. The circuit breaker of claim 3 in which the plate comprises aperture means for controlling the hold-back force on the armature.

9. The circuit breaker of claim 3 in which the set screw means are disposed between the flanges and the armature for varying the spacing therebetween.

10. A circuit breaker structure having a faster trip action, comprising:

a circuit breaker mechanism having separable contacts and having a releasable member movable to an unlatched position from a latched position to effect opening of the contacts;

a latch lever movable between latched and unlatched positions of the releasable member and being biased in the latched position;

a trip bar movable to unlatch the latch lever and being biased in the latched position;

a trip unit comprising a stationary magnetic structure for each conductor of the distribution system and including a coil and first core assembly and an armature;

lever means associated with each stationary magnetic structure for moving the trip bar to the unlatched position;

the lever means comprising the armature and movable toward the core in response to abnormal currents in at least one of the conductors;

a flux concentrating plate spaced from and on the side of the armature opposite the core and for concentrating a magnetic field in an ambient space between the core and the armature;

the flux concentrating plate including calibration means for moving the plate to and from the armature so as to adjust the magnetic field assembly; and the flux concentrating plate being a substantially U-shaped member having an intermediate portion and third U-legs slidably mounted on respective first U-legs of the core; and set screw means for adjusting the spacing between the intermediate portion and the core and the armature being disposed between the third U-legs and in contact with the member.

* * * * *